United States Patent [19]

Russell

[11] 4,333,300

[45] Jun. 8, 1982

[54] ENVELOPE PROCESSING MACHINE AND METHOD

[75] Inventor: Robert J. Russell, Medford, N.J.

[73] Assignee: Mail-Ex Corporation, Skokie, Ill.

[21] Appl. No.: 154,873

[22] Filed: May 30, 1980

[51] Int. Cl.[3] ..... B65B 43/30

[52] U.S. Cl. ..... 53/569; 53/386; 83/404.2; 83/912; 414/412

[58] Field of Search ..... 83/912, 404.2, 404.1; 53/381 R, 386, 569, 570, 571; 414/412

[56] References Cited

U.S. PATENT DOCUMENTS

| | | | |
|---|---|---|---|
| 3,143,100 | 8/1964 | Krupotich | 83/912 X |
| 3,384,252 | 5/1968 | West | 414/412 |
| 3,691,726 | 9/1972 | Stephens et al. | 83/912 X |
| 3,927,589 | 12/1975 | Emkjer et al. | 83/912 X |
| 3,979,884 | 9/1976 | Russell | 53/381 R |
| 4,159,611 | 7/1979 | Russell | 53/569 |
| 4,233,800 | 11/1980 | Long et al. | 53/381 R |
| 4,262,471 | 4/1981 | Russell | 53/569 X |

*Primary Examiner*—Frank T. Yost

*Attorney, Agent, or Firm*—Trexler, Bushnell & Fosse, Ltd.

[57] ABSTRACT

The present invention provides a machine and method wherein envelopes are removed from a supply hopper, one by one, and then transmitted to a plurality of sequentially disposed cutting stations wherein one end edge of the envelope is first severed, and thereafter an adjacent side edge of the envelope is severed. The envelope with two adjacent edges thus severed is transmitted to a processing station at which the envelope is opened and held open by suction cups, for removal of contents by an operator. The envelope is thereafter transmitted to a detector station to confirm content removal and then to a recovery station, and then to a point of discharge. Means is provided for adjusting the opening of the suction cups at the processing station, and stop means is provided for positioning the envelope as it reaches the processing station. The envelope is transmitted toward the processing station in horizontal disposition, and in one form of the invention at the processing station it is repositioned into angular disposition prior to the gripping action of the suction cups.

18 Claims, 13 Drawing Figures

FIG. 7
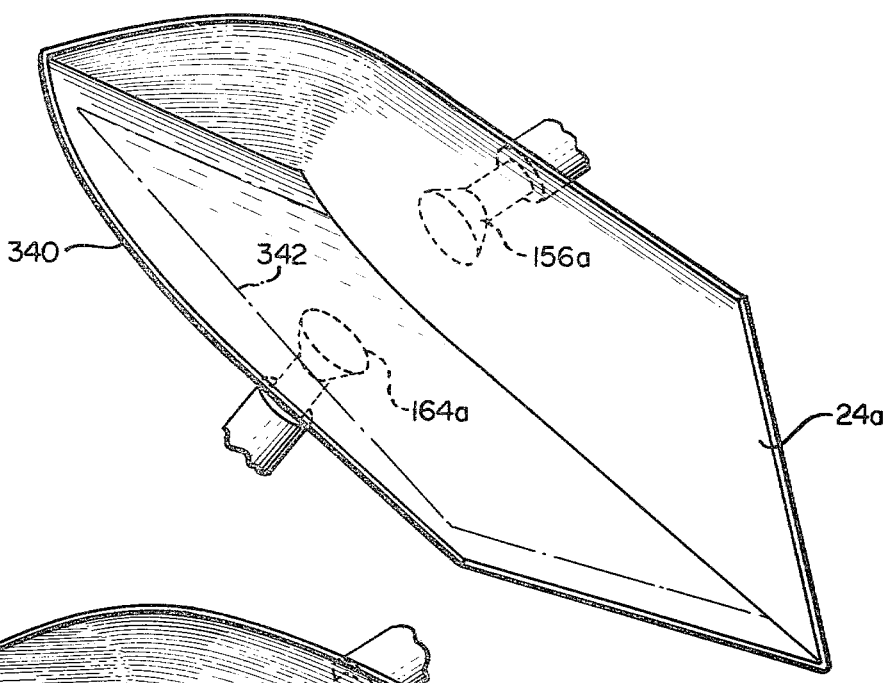
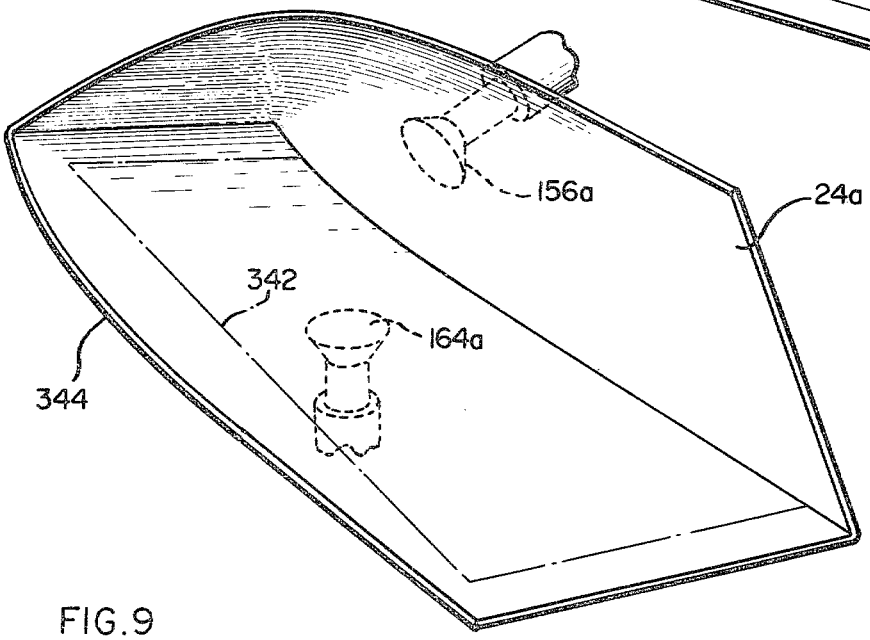
FIG. 8
FIG. 10
FIG. 9
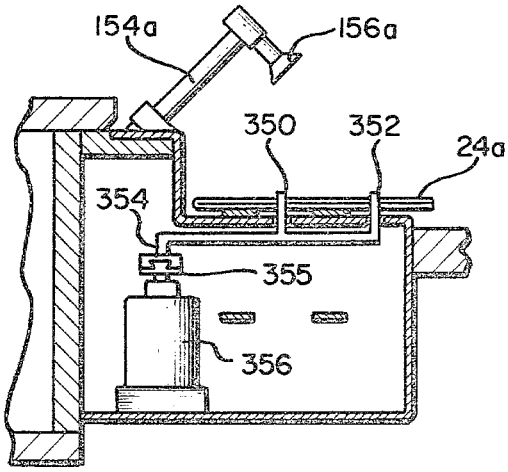
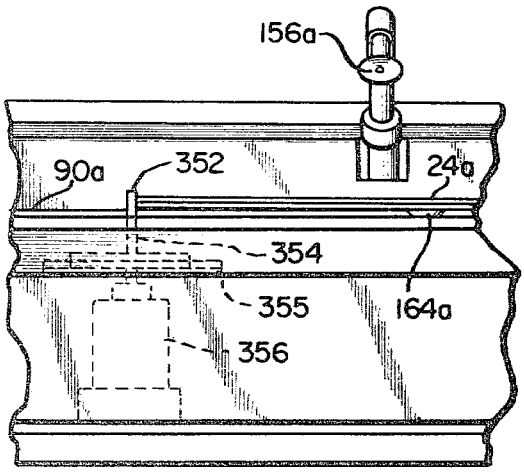

ENVELOPE PROCESSING MACHINE AND METHOD

BACKGROUND OF THE INVENTION

The machine and method of the present invention is an improvement of the machine and method set forth in my prior application, Ser. No. 801,454, filed May 31, 1977, now issued as U.S. Pat. No. 4,159,611 dated July 3, 1979, to which reference may be made for certain details of disclosure.

Envelope processing machines are provided in the prior art for extracting the contents from envelopes, wherein the envelope is severed along three sides, and laid essentially flat with the contents exposed for extraction. Such machines are usually high-speed, complex and expensive; designed primarily for very large volume operations. Such machines may be attended by a large number of operators working at several stations upon various aspects of the opening and content removal process.

An alternate form of machine is shown in my said prior U.S. Pat. No. 4,159,611. This machine, while semi-automatic in character, is generally intended for somewhat lower volume operation, and is attended by a single operator, who manually extracts the contents from the envelopes at the processing station. In such machines, the disposition of the envelope at the processing station, for ease of content removal, is a matter of considerable importance to facilitate operations, and to minimize operator fatigue.

While the machine and method of said prior U.S. Pat. No. 4,159,611 has proved to be efficacious, the present invention provides certain further improvements with respect to the preliminary conditioning of the envelope before it reaches the processing station, and for control and disposition of the envelope at the processing station, whereby to further facilitate the removal of contents from the envelope, to speed operations, and to minimize operator fatigue.

OBJECTS AND SUMMARY OF THE INVENTION

In accordance with the present invention, the envelopes to be opened are subjected to a plurality of conditioning operations, prior to transmission to the processing station. More particularly, in accordance with the present invention the envelopes to be opened, and the contents removed, are removed from a supply hopper, in one by one relationship, and transmitted to a first cutting station where one edge of the envelope is severed, and thereafter to a second cutting station, where an adjacent edge of the envelope is severed, prior to transmission to the processing or content removal station. Preferably, and in the particular embodiment disclosed, and end edge of the envelope is first severed and removed, and thereafter an adjacent side edge of the envelope is severed and removed; whereby, as the envelopes reach the opening or processing station, two adjacent edges have been severed which greatly facilitates accesss to the envelope contents and removal thereof, at the processing station.

A pair of relatively movable, oppositely disposed suction cups is positioned at the processing station for gripping the opposite faces of the envelope, and effecting the separation thereof in a predetermined amount. As will be hereinafter more particularly set forth, it has been found that with this arrangement, the envelope contents, almost regardless of character, "stand away" from the envelope side walls or faces so that the contents may be readily removed.

Certain envelope contents, whether by reason of thin wall character, or static, or for whatever other reason, tend to adhere to the envelope sidewalls, even after the envelope has been opened, thereby inhibiting or making more difficult the removal of such contents from the envelope. Such adherence may be accentuated by the negative pressure produced by the suction cups which "bleeds through" the envelope side walls, thereby further creating a tendency for the envelope contents to adhere to the envelope side walls to inhibit content removal.

It has been found that by severing two adjacent edges of the envelope, coupled with the suction cup action and envelope disposition hereinafter more particularly set forth, adherence of the contents to the side walls is greatly minimized, and content removal facilitated.

It is an object of the present invention to provide an improved envelope processing machine and method whereby the envelope contents may be more readily removed at the content removal or processing station.

More particularly stated, it is an object of the present invention to provide an improved machine and method in a semi-automatic operator attended machine, wherein the envelope contents at the content removal or processing station will more reliably "stand away" from the envelope side walls, thereby facilitating content removal by the operator, either by a direct gripping action upon the contents, or by a sliding action, as the operator may prefer.

A further object of the invention is to provide, in a machine and method of the type defined, an improved means for locating the position of the envelope at the processing station.

A still further object of the invention is to provide, in one embodiment, means for repositioning the angular disposition of the envelope as it reaches the processing station, whereby to facilitate content removal by a sliding operation, as an operator may prefer.

Various other objects, advantages and features of the invention will be apparent from the following specification, taken in connection with the accompanying drawings, wherein certain preferred embodiments of the invention are set forth for purposes of illustration.

DESCRIPTION OF THE FIGURES OF THE DRAWINGS

FIGS. 7 and 8 are perspective illustrative views, showing the opened envelope, and the indicated contents, in the positions respectively of FIGS. 4 and 5.

FIG. 9 is a detail sectional view of the envelope locating means at the processing station.

FIG. 10 is a detail view of the structure of FIG. 9 as seen from the right thereof.

DETAILED DESCRIPTION OF THE INVENTION

Figure 1:
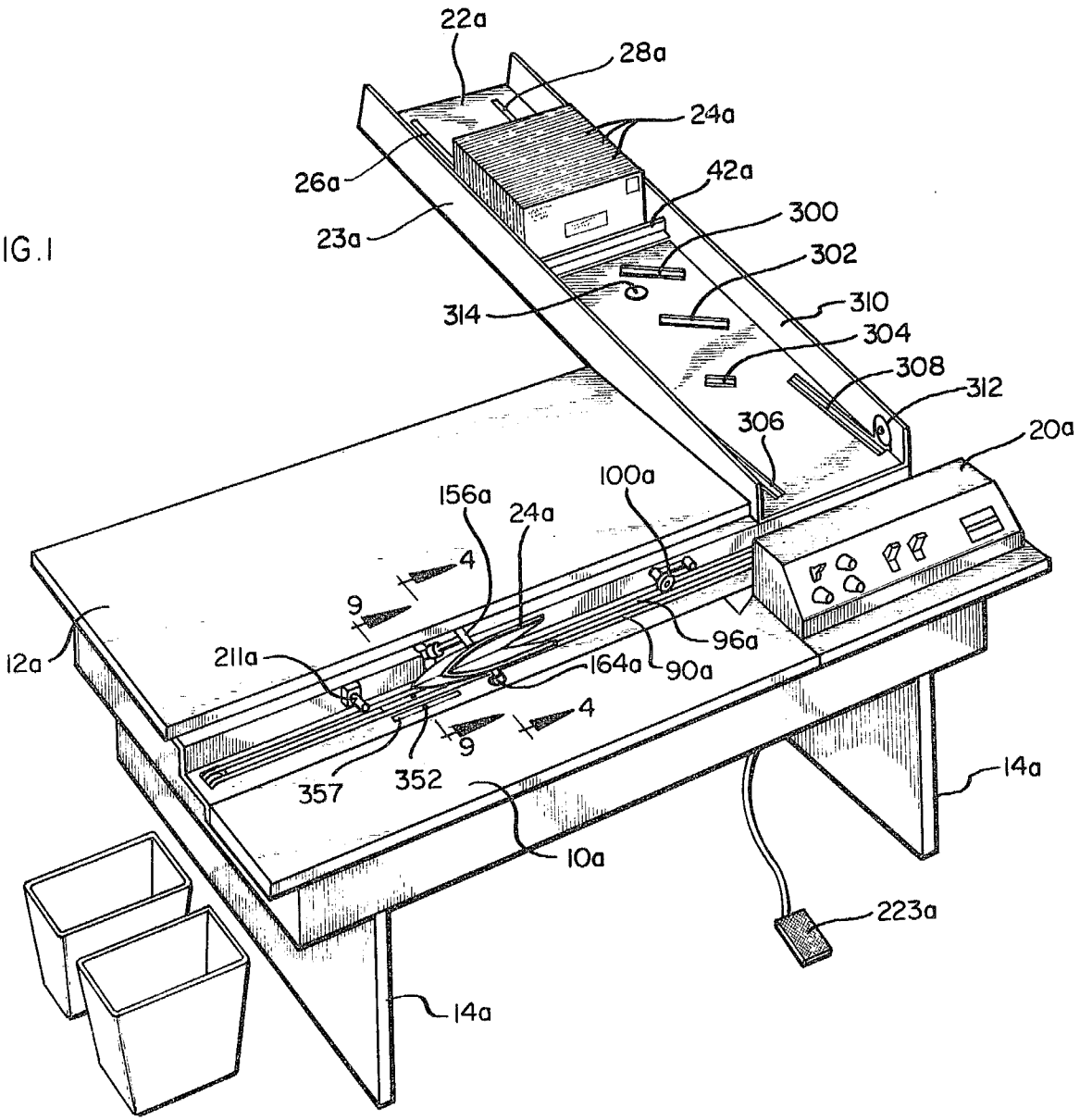
FIG. 1 is a general perspective view of a machine embodying the principals of the present invention, built in accordance with one selected embodiment thereof.

As previously set forth, the present machine constitutes an improvement upon the machine of my said prior U.S. Pat. No. 4,159,611, and reference may be made thereto for various details of the construction. For correlation, reference numerals will be used herein, in part, in relation to similar structures in the disclosure of said prior patent.

Referring to FIG. 1, the machine comprises a lower front table structure 10*a* and a rear higher table structure 12*a*, supported by legs 14*a*, as in the patent previously described. Viewed from the front, the right hand end of the machine carries an inclined table 22*a*, of greater length as compared with the table of the prior patent. Motor driven feed belts, or chains, 26*a* and 28*a* are provided, FIGS. 1 and 2, controlled by switch means, as in the prior patent, for a plurality of envelopes 24*a*; the inclined table thus constituting a supply hopper for envelopes, as in the machine of the patent previously described.

In the machine of the prior invention, and as more particularly shown in FIG. 31 thereof, a feed and cutting station is provided for cutting the side edge of an envelope, such feed and cutting means herein comprising angularly disposed feed belts 272*a* and 274*a*, and a feed roller 276*a*, cooperative with a feed belt 106*a* of lesser angularity; provided and arranged to cause the side edge of an envelope to be abutted against a side plate 110*a* and then transmitted to rotary cutting knives, the upper of which is shown at 114*a*, all disposed and functioning as described in said prior patent.

In the machine of the present invention, an additional feed and cutting station is provided, operable to sever an end edge of the envelope, prior to transmission of the envelope to the feed and cutting station for the side edge, as previously described. To this end there is provided a pair of angularly disposed feed belts 300 and 302, functioning in a manner similar to belts 272*a* and 274*a*; and a roller 304 similar to roller 276*a*, cooperable with additional feed belts 306 and 308, of lesser angularity and similar to feed belt 106*a*, all cooperable and functioning to project an envelope end edge against a guide-plate 310, and for transmission of the envelope to a pair of rotary cutting knives, the upper one of which is indicated at 312, for severing the end edge of an envelope prior to transmission to the side edge cutting means.

Figure 2:
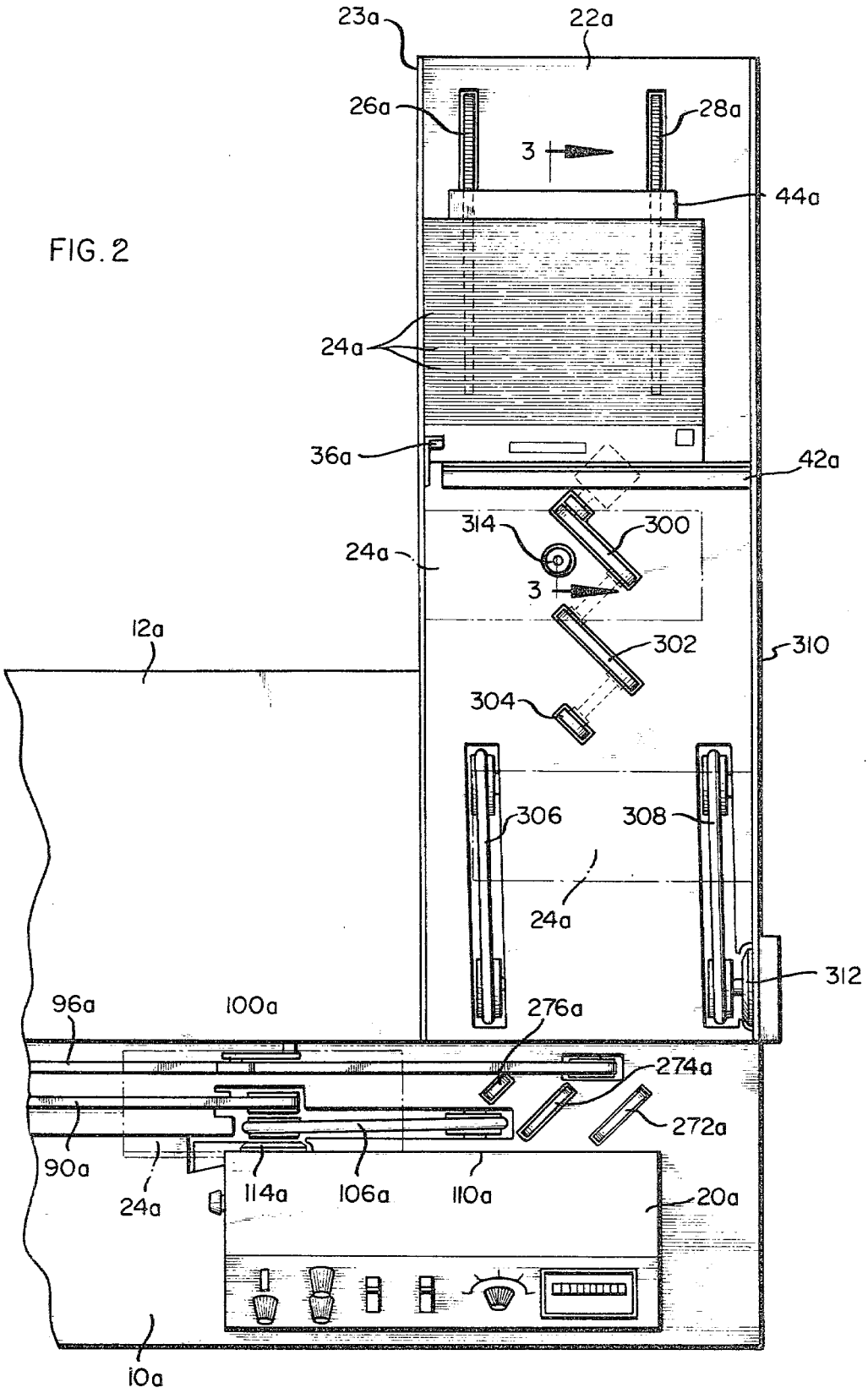
FIG. 2 is a partial plan view of the machine of FIG. 1, showing more particularly the envelope supply hopper, and the envelope end-cutting and side-cutting stations.
Figure 3:
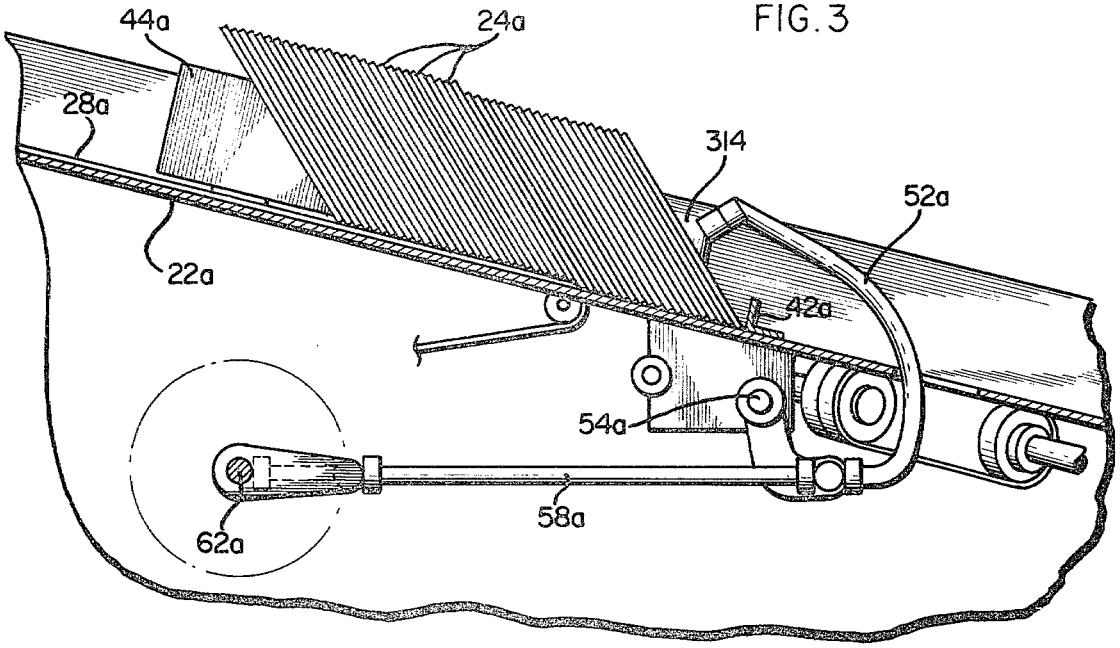
FIG. 3 is a partial sectional view of the structures shown in FIG. 2, taken along the line 3—3 thereof.

To transmit the envelopes from the supply hopper in one by one relationship to the end-cutting means described, a vacuum cup 314, FIGS. 2 and 3, is provided, said vacuum cup being functionally similar to the vacuum cup 52 of my prior patent; only in this instance the vacuum cup removes the envelopes in one by one relationship from the supply hopper and desposits them upon the inclined table 22, overlying feed belts 300 and 302. As will be understood, the vacuum cup is shifted by a control arm 52*a* operable upon a rock shaft 54*a* under control of linkage 56*a* and 62*a*, all functioning as in the case of the control arm 52 of the prior patent.

It will be seen that by reason of the structures described, the envelopes are removed from the envelope stack in the hopper, in one by one relationship, by suction cup 314, and deposited upon feed belts 300 and 302, which upon operation together with feed roller 304, transmit the deposited envelope longitudinally and laterally against the guide-plate 310, and upon continued transmission by feed belts 306 and 308 the envelope is transmitted through cutter 312 to sever the end edge of the envelope. The envelope, with the end edge thus severed, is deposited by feed belts 306 and 308, and cutter 312, onto the support table surface for the second feed and cutting means. Upon operation of feed belts 272*a* and 274*a*, roller 276*a* and feed belt 106*a*, an envelope so positioned is fed into rotary cutting means 114*a* so as to sever a side edge of the envelope, adjacent end and side edges of the envelope thus having been severed and removed. Waste receiving means for the end cuts of the envelopes may be provided for the receiving of scraps, as with the side cutting means as described in my previous patent.

As in the previously described patent, the envelopes are transmitted in one by one relationship in horizontal disposition, from the cutting means 114*a* to the content removal and processing station, by the periodically operable feed belts 90*a* and 96*a*; and reference will now be made to FIGS. 1, 4, 5 and 6.

At the processing station, there is provided a pair of separable and thus relatively movable suction cups 156*a* and 164*a*, the control linkages for which are described in my said prior patent. More particularly, the suction cup 156*a* for the upper envelope face is controlled by arm 154*a*, FIG. 4, whereas the suction cup 164*a* for the lower envelope face is controlled by arm 178*a*, as described in said prior patent, and as shown herein in FIG. 4. In said prior patent, and as best shown in FIGS. 19 and 20 thereof, a fixed stop (indicated as 184) is provided for limiting the upper travel of the lower suction cup; whereas in the present machine the limit stop for the lower suction cup arm 178*a* is made adjustable.

Figure 6:
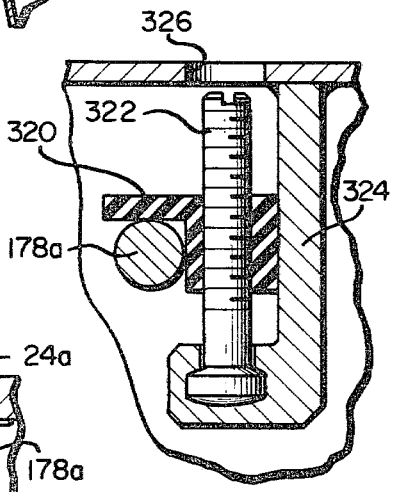
FIG. 6 is a detailed view, more particularly showing the stop means for adjusting the action of the lower suction cup.

As best shown in FIG. 6, the adjustable stop may comprise a block 320 of plastic or the like, screw-threaded onto a stud 322 journaled within a depending bracket 324 depending from the envelope support table. The table is provided with an opening 326 so that the stud may be suitably manipulated with a screw driver or the like, and during its adjustment the stop is slidable along the face of bracket 324 as will be understood.

Figure 4:
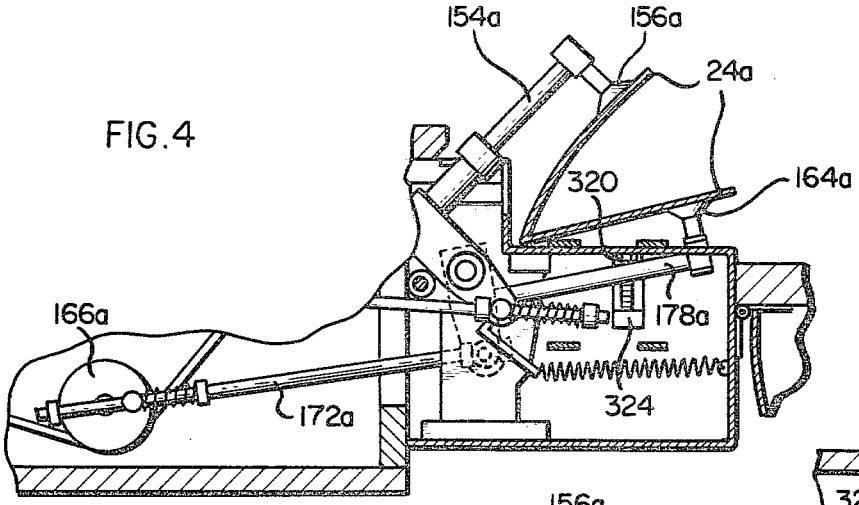
FIG. 4 is a detail sectional view of the machine and an envelope, at the content removal or processing station taken along the line 4—4 of FIG. 1.
Figure 5:
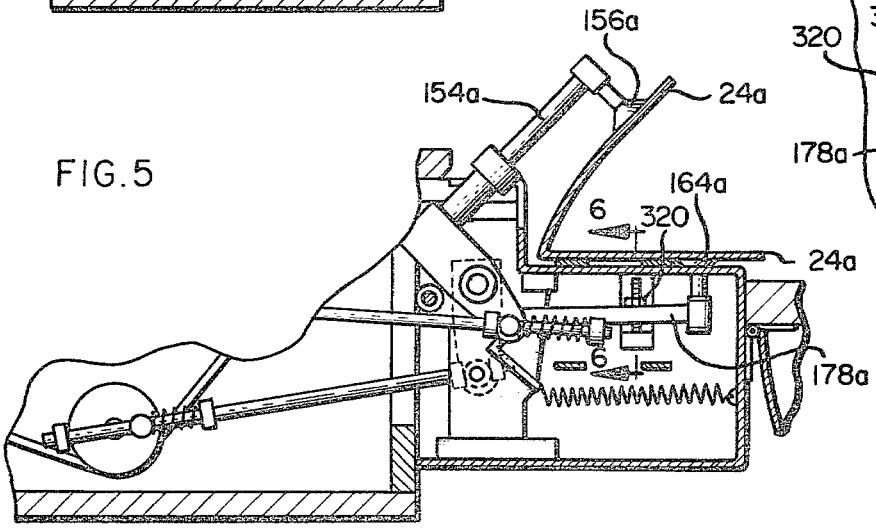
FIG. 5 is a view similar to FIG. 4, but showing the suction cup for controlling the lower envelope wall or face, in a different adjusted position.

In FIG. 4, stop 320 is shown in an upper position of adjustment whereby to dispose the lower face of the envelope at an upwardly inclined angle, in a manner generally similar to the disposition of the envelope at the processing station in my said prior patent. In FIG. 5, stop 320 is shown in a lower position of adjustment, so as to hold the lower face of the envelope essentially horizontal when the envelope is moved to open position.

Reference is now made to FIGS. 7 and 8.

In FIG. 7, the envelope is shown opened as in FIG. 4. It will be seen that with two adjacent edges of the envelope severed, and the suction cups disposed as shown, the lower face of the envelope tends to take a relatively sharp bend as indicated by the reference numeral 340, which causes the contents indicated by the reference numeral 342 to stand away from the lower wall of the envelope, so as to facilitate content removal and to minimize any "bleed through" of suction or negative pressure from the suction cup 164*a* to cause the envelope contents to adhere to the lower envelope sidewall. Gravity, of course, tends to minimize adherence of the envelope contents to the upper envelope side wall, along with the imparted curvature due to the double edge opening and the disposition of the suction cup members.

In FIG. 8 similar conditions are illustrated with the envelope opened in the manner indicated in FIG. 5. Again, and even more pronounced, a curvature is imparted to the lower side wall of the envelope, as indicated by the reference numeral 344, causing the envelope contents to "stand away" from the lower envelope wall. With the envelope opened, as in FIGS. 5 and 8, essentially one-half or more of the envelope lower wall remains substantially horizontal.

In accordance with the present invention, locating means may be provided for more accurately positioning the envelope at the processing station. Such means is illustrated in FIGS. 9 and 10.

As seen in FIGS. 9 and 10, a pair of stop pins 350 and 352 is provided, formed as a part of a bracket 354, which bracket is dovetailed to and frictionally longitudinally slidable upon a support 355 formed as the armature of an electro-magnet 356. The arrangement is such that the support 355 and bracket 354 are projected upwardly to position the stops for engagement by the envelope, when the electro-magnet is energized, the support being spring returned to a lowered, inoperative position by spring means within the electro-magnet (not shown). Bracket 354 may be longitudinally frictionally adjusted on support 355 by manually pushing on the stop pins, the envelope support plate being slotted as indicated at 357 for this purpose.

OPERATION

In the operation of the structures described, a supply of envelopes 24*a* to be opened is stacked onto the inclined table of the supply hopper, as indicated in FIG. 1. Upon operation of the machine, the suction cup 314 operates to remove the envelopes from the supply hopper in one by one relationship, laying each envelope onto the feed belts 300 and 302. The feed belts are operable in predetermined timed relation with the suction cup and along with the associated feed roller 304 and the feed belts 306 and 308, and cutter 312 operate to sever the end edge of the envelope as it is transmitted through the cutter device.

From the cutter 312 the envelope is laid onto feed belts 272*a* and 274*a*, FIG. 2, which upon timed operation function with the associated feed means and cutter 114*a* to sever the adjacent side edge of the envelope.

The envelope thus opened on two adjacent edges, is fed by belts 90*a* and 96*a* to the processing station. At the content removal or processing station, the suction cups 156*a* and 164*a* are operable in predetermined timed relation, as described in said prior patent, so as to open an envelope transmitted to the processing station by the feed belts. The envelope is located longitudinally by retractable stop pins 350 and 352, FIG. 9, as previously described. When retracted, suction cup 164*a* does not contact or interfere with the longitudinal movement of an oncoming envelope.

Suction cups 156*a* and 164*a* may open the envelope, optionally, as in FIG. 4 or as in FIG. 5, depending upon the adjustment of stop member 320.

As has been previously explained, due to the two adjacent severed edges of the envelope, and the disposition of the suction cups, accessibility of the envelope contents for removal is maximized at the processing station; and the operator may grasp the contents for removal or "wipe" the contents outwardly from the lower envelope side wall in a removal operation.

MODIFICATION OF FIGS. 11, 12 AND 13

In certain instances it may be desirable to reposition the envelope, as it reaches the processing station, to facilitate content removal, as certain operators may prefer. Such mechanism is shown in FIGS. 11, 12 and 13.

Figure 11:
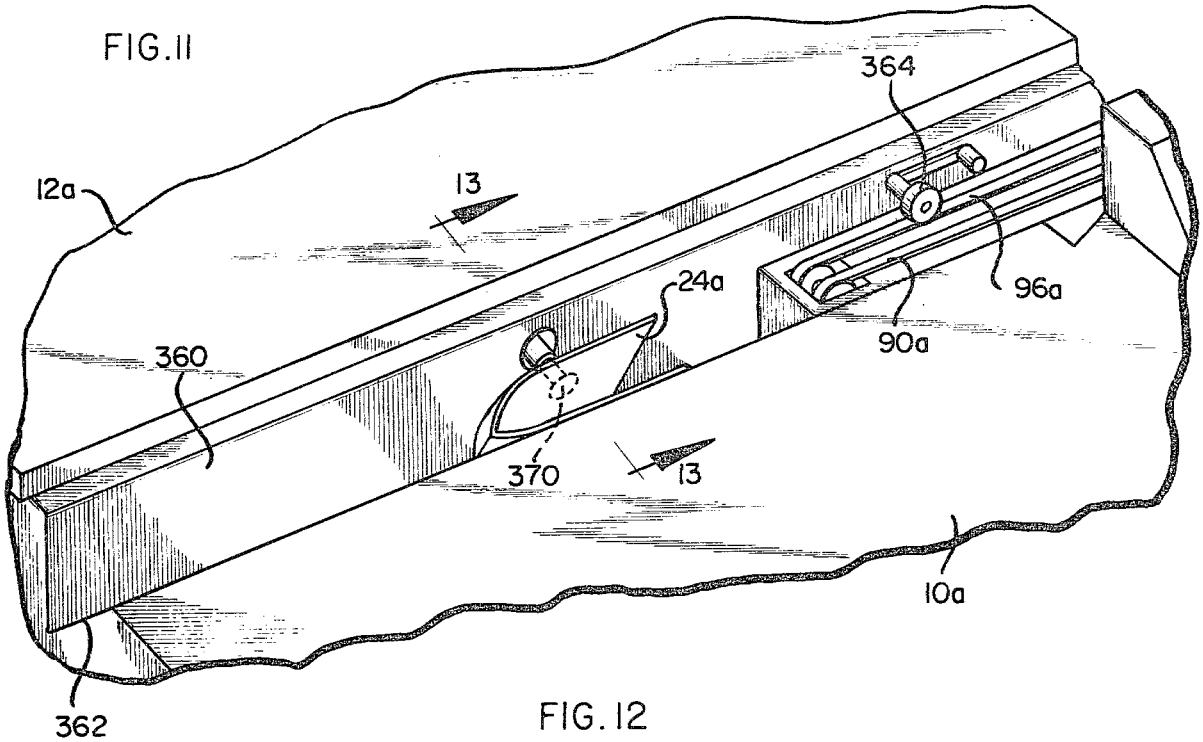
FIG. 11 is a partial perspective view of a modified form of the invention, showing means for repositioning the attitude of the envelope as it reaches the processing station.

Refering to FIG. 11, at the processing station, and to the left thereof as the machine is viewed in FIG. 1, the envelope travel path is recessed, in a manner somewhat similar to my prior U.S. Pat. No. 3,979,884 dated Sept. 14, 1976. More particularly, and as seen in FIG. 11, at the processing station and extending leftwardly therefrom, there is provided an elongated trough or well formed with a rear vertical wall 360, and an inclined forward wall 362, into which the envelopes are deposited at the processing station by the feed belts 90*a* and 96*a* functioning as previously described. To provide more positive control by feed belts 90*a* and 96*a*, a gravity actuated pressure roller cooperates with belt 96*a*, indicated in FIG. 11 by the reference numeral 364.

Figure 12:
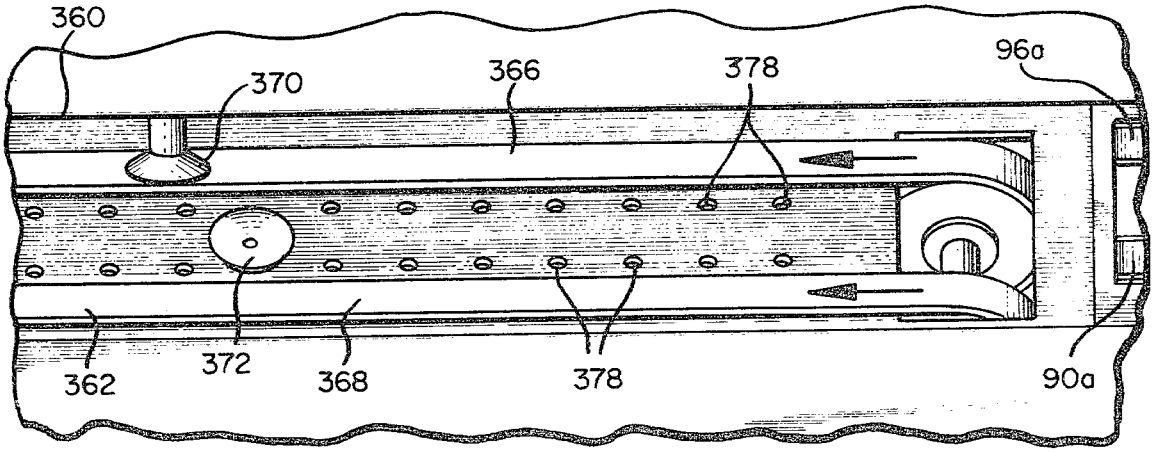
FIG. 12 is a partial top view of the structure shown in FIG. 11.
Figure 13:
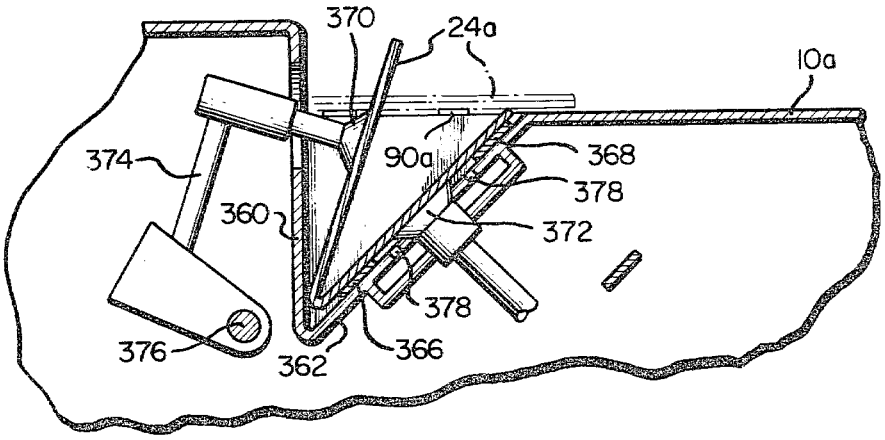
FIG. 13 is a partial sectional view thereof on the line 13—13 of FIG. 11.

As shown in FIGS. 12 and 13, the sloping forward wall 362 carries a pair of feed belts 366 and 368 which are operable in timed relation with the feed belts 90*a* and 96*a*. A reciprocating suction cup 370 is provided for gripping the upper face of the envelope, whereas the lower inclined wall 362 is provided with a stationary suction cup 372 for the lower envelope wall. Cup 370 is reciprocable by an arm 374 operable upon a rock shaft 376, FIG. 13.

The inclined forward wall 362 of the envelope channel is provided with a series of openings 378 connected to a vacuum plenum chamber so as to hold the lower face of the envelope sufficiently against feed belts 366 and 368 to insure an adequate and positive drive.

In the operation of the structure of FIG. 11–13, as the envelope reaches the processing station it is projected by the feed belts 90*a* and 96*a* into the recessed well formed by walls 360 and 362, whereupon it is engaged by feed belts 366 and 368 for continued movement until the belts stop and the envelope is properly positioned at the processing station. If desired, retractable locating pins such as pins 350 and 352, (FIG. 9) previously described, may be provided.

At the processing station, as negative pressure or vacuum is applied to the fixed suction cup 372, the lower wall of the envelope will be gripped and held, and as the upper suction cup 370 is projected forward into envelope engagement and negative pressure applied to grip the envelope wall, and the suction cup then retracted, the envelope will be opened as shown in FIGS. 11 and 13. The contents may be thereupon removed by the operator gripping the contents, or the contents may be removed by a sliding action outwardly from the lower envelope wall, as will be understood. As in the embodiment previously described, the adjacent severed envelope edges, and the disposition of the suction cups, promote disengagement of the envelope contents from the envelope walls to facilitate content removal. Negative pressure is applied to the suction cups 370 and 372 at timed intervals, coordinated with the action of the feed belts; whereas negative pressure from the plenum chamber is applied to openings 378, in lesser magnitude continuously.

It is obvious that various changes may be made in the specific embodiments shown and described, without departing from the spirit of the invention The invention is claimed as follows:

1. An envelope processing machine to facilitate operator removal of envelope contents and comprising a supply hopper for envelopes, first cutting means for severing an edge of an envelope, second cutting means for severing an adjacent and contiguous edge of an envelope, means for removing envelopes in one by one relationship from said hopper and conveyor flight means providing movable support for the envelope and for transmitting them with continuous movement along a first path of travel to and through said first cutting means to sever the edge paralleling the first path of travel of movement of the envelope, an envelope processing station, conveyor means for transmitting the envelopes with continuous movement along a second path of travel of movement of the envelope to and through the second cutting means to sever an adjacent and contiguous edge paralleling the second path of travel of movement of the envelope and then to the processing station, and means disposed at the processing station for gripping the opposed envelope side walls and for separating and holding open said side walls by separating the severed adjacent and contiguous edges leaving the counterpart adjacent and contiguous edges connected to facilitate envelope content removal by operator gripping or sliding of the contents.

2. An envelope processing machine as in claim 1 wherein said cutting means are sequentially operable upon the envelopes along substantially right angled paths of travel of the envelopes with the second path of travel projecting to the processing station.

3. An envelope processing machine as in claim 1 wherein each cutting means comprises feed means angularly disposed in respect to the path of travel of the envelopes, a guide plate against which the feed means directs the edge of the envelope to be cut, and a rotary cutting knife with its axis at right angles to the respective path of travel and positioned to sever the plate-engaged envelope edge in parallel to the respective path of travel of the envelope.

4. An envelope processing machine as in claim 1 wherein the envelopes are transmitted through the cutting means in substantially horizontal disposition.

5. An envelope processing machine as in claim 1 wherein the envelopes are transmitted from the cutting means to the processing station in substantially horizontal disposition.

6. An envelope processing machine as in claim 1 wherein said envelope gripping means comprises a pair of suction cups operable upon the opposed envelope side walls.

7. An envelope processing machine as in claim 6 wherein means is provided for adjusting the degree of separation of at least one of said suction cups.

8. An envelope processing machine as in claim 6 wherein one suction cup holds one envelope wall substantially horizontal as the cups move the envelope walls to open position.

9. An envelope processing machine as in claim 1 wherein locating means is provided at the processing station for longitudinally positioning the envelope in its path of travel.

10. An envelope processing machine as in claim 9 wherein said locating means is adjustable.

11. An envelope processing machine as in claim 5 wherein the envelopes are repositioned into angular disposition at the processing station with the opened severed edges facing the operator position.

12. An envelope processing machine as in claim 11 wherein envelope control means is provided at the processing station comprising an angularly disposed wall including a substantially stationary wall as the envelope is opened.

13. An envelope processing machine as in claim 11 wherein envelope control means is provided at the processing station comprising an angularly disposed wall, said wall being provided with a feed belt and openings for application of negative pressure to an engaged envelope wall.

14. The method of processing envelopes which comprises severing two adjacent and contiguous edges of an envelope, and thereafter opening the envelope by drawing the walls thereof apart by the application of negative pressure separating the severed adjacent and contiguous edges while leaving the counterpart adjacent and contiguous edges as originally attached.

15. The method of processing envelopes as in claim 14 wherein the envelope walls upon the opening movement are brought into and held in a predetermined open position by negative pressure.

16. The method of processing envelopes as in claim 14 wherein one envelope wall is held stationary by the negative pressure during the opening movement.

17. The method of processing envelopes as in claim 14 with the envelopes in continuous movement while being severed.

18. The method of processing envelopes as in claim 17 with the severing of the said edges being parallel to the direction of movement of the envelopes.

* * * * *